US006368146B2

(12) United States Patent
Abbott

(10) Patent No.: US 6,368,146 B2
(45) Date of Patent: Apr. 9, 2002

(54) ALIGNMENT MECHANISM FOR A HIGH DENSITY ELECTRICAL CONNECTOR

(76) Inventor: Russell Abbott, 2616 Cross St., Riverside, CA (US) 92503

( * ) Notice: Subject to any disclaimer, the term of this patent is extended or adjusted under 35 U.S.C. 154(b) by 0 days.

(21) Appl. No.: 09/761,193

(22) Filed: Jan. 16, 2001

Related U.S. Application Data

(60) Provisional application No. 60/227,855, filed on Aug. 23, 2000.

(51) Int. Cl.[7] ..... H01R 3/00

(52) U.S. Cl. ..... 439/489; 29/712; 439/677

(58) Field of Search ..... 439/68, 525, 489, 439/83, 677; 29/525.06, 760, 712, 888.2

(56) References Cited

U.S. PATENT DOCUMENTS

| | | | | |
|---|---|---|---|---|
| 4,621,882 | A | 11/1986 | Krumme | 439/67 |
| 4,743,079 | A | 5/1988 | Bloch | 439/161 |
| 4,787,854 | A | 11/1988 | Le Parquier | 439/77 |
| 4,801,279 | A | 1/1989 | Nakanishi | 439/877 |
| 4,911,643 | A | 3/1990 | Perry et al. | 439/877 |
| 5,092,781 | A | 3/1992 | Casciotti et al. | 439/67 |
| 5,334,031 | A | 8/1994 | Schmidt | 439/161 |
| 5,615,477 | A | 4/1997 | Sweitzer | 361/743 |
| 5,685,721 | A | 11/1997 | Decker | 439/114 |
| 5,712,767 | A | 1/1998 | Koizumi | 361/761 |
| 5,737,192 | A | 4/1998 | Linderman | 361/790 |
| 5,783,870 | A | 7/1998 | Mostafazadeh et al. | 361/764 |
| 5,790,384 | A | 8/1998 | Ahmad et al. | 361/760 |
| 5,821,664 | A | 10/1998 | Shahinpoor | 310/307 |
| 5,831,820 | A | 11/1998 | Huang | 361/686 |
| 5,847,936 | A | 12/1998 | Forehand et al. | |
| 5,856,914 | A | 1/1999 | O'Boyle | 361/761 |
| 5,875,100 | A | 2/1999 | Yamashita | 361/764 |
| 5,888,083 | A | 3/1999 | Seilhan et al. | 439/161 |
| 5,982,187 | A | 11/1999 | Tarzwell | 324/761 |
| 6,034,532 | A | 3/2000 | Tarzwell | 324/761 |

*Primary Examiner*—Renee Luebke
*Assistant Examiner*—Briggitte R. Hammond
(74) *Attorney, Agent, or Firm*—Knobbe, Martens, Olson & Bear, LLP

(57) ABSTRACT

A electrical connector suitable for aligning and connecting a high-density wire bundle to a receiving member. The wire bundle is attached to an adapter positioned within a mounting location containing electronically controlled, adjustable pushrods which are used to make the fine lateral and rotational adjustments to the adapter. A control unit detects the position of the adapter within the mounting location and makes fine adjustments to the adapter position as necessary to insure proper alignment and contact.

51 Claims, 9 Drawing Sheets

410 400 402

| Sensor | Direction | | | | | | | | | |
|---|---|---|---|---|---|---|---|---|---|---|
| Position | Top | Right | Down | Left | CW | CW | CCW | CCW | Nul | Nul |
| State | 1 | 2 | 3 | 4 | 5 | 6 | 7 | 8 | 9 | 10 |
| 1 | 1 | 0 | 0 | 0 | 1 | 0 | 0 | 0 | 0 | 1 |
| 2 | 1 | 0 | 0 | 0 | 0 | 0 | 1 | 0 | 0 | 1 |
| 3 | 0 | 1 | 0 | 0 | 0 | 1 | 0 | 0 | 0 | 1 |
| 4 | 0 | 1 | 0 | 0 | 0 | 0 | 0 | 1 | 0 | 1 |
| 5 | 0 | 0 | 1 | 0 | 1 | 0 | 0 | 0 | 0 | 1 |
| 6 | 0 | 0 | 1 | 0 | 0 | 0 | 1 | 0 | 0 | 1 |
| 7 | 0 | 0 | 0 | 1 | 0 | 1 | 0 | 0 | 0 | 1 |
| 8 | 0 | 0 | 0 | 1 | 0 | 0 | 0 | 1 | 0 | 1 |

420

430 404 406

| Actuator | Top | Right | Down | Left | CW | CW | CCW | CCW | NUL | NUL |
|---|---|---|---|---|---|---|---|---|---|---|
| 1 | 1 | 0 | 0 | 0 | 1 | 0 | 0 | 0 | 0 | 0 |
| 2 | 1 | 0 | 0 | 0 | 0 | 0 | 1 | 0 | 0 | 0 |
| 3 | 0 | 1 | 0 | 0 | 0 | 1 | 0 | 0 | 0 | 0 |
| 4 | 0 | 1 | 0 | 0 | 0 | 0 | 0 | 1 | 0 | 0 |
| 5 | 0 | 0 | 1 | 0 | 1 | 0 | 0 | 0 | 0 | 0 |
| 6 | 0 | 0 | 1 | 0 | 0 | 0 | 1 | 0 | 0 | 0 |
| 7 | 0 | 0 | 0 | 1 | 0 | 1 | 0 | 0 | 0 | 0 |
| 8 | 0 | 0 | 0 | 1 | 0 | 0 | 0 | 1 | 0 | 0 |

408

450

| Sensor Position | Direction Top | Right | Down | Left | CW | CCW | Nul | Nul |
|---|---|---|---|---|---|---|---|---|
| State | 1 | 2 | 3 | 4 | 5 | 6 | 9 | 10 |
| 1 | 1 | x | 0 | x | x | x | 0 | 1 |
| 2 | x | 0 | x | 1 | 0 | 1 | 0 | 1 |
| 3 | 0 | x | 1 | x | 1 | 0 | 0 | 1 |
| 4 | x | 1 | x | 0 | x | x | 0 | 1 |
| 5 | 0 | x | 1 | x | x | x | 0 | 1 |
| 6 | x | 1 | x | 0 | 0 | 1 | 0 | 1 |
| 7 | 1 | x | 0 | x | 1 | 0 | 0 | 1 |
| 8 | x | 0 | x | 1 | x | x | 0 | 1 |

460

465

470

| Actuator | | | | | | | | |
|---|---|---|---|---|---|---|---|---|
| 1 | 1 | 0 | 0 | 0 | 1 | 0 | 0 | 0 |
| 2 | 1 | 0 | 0 | 0 | 0 | 0 | 0 | 0 |
| 3 | 0 | 1 | 0 | 0 | 0 | 1 | 0 | 0 |
| 4 | 0 | 1 | 0 | 0 | 0 | 0 | 0 | 0 |
| 5 | 0 | 0 | 1 | 0 | 1 | 0 | 0 | 0 |
| 6 | 0 | 0 | 1 | 0 | 0 | 0 | 0 | 0 |
| 7 | 0 | 0 | 0 | 1 | 0 | 1 | 0 | 0 |
| 8 | 0 | 0 | 0 | 1 | 0 | 0 | 0 | 0 |

ALIGNMENT MECHANISM FOR A HIGH DENSITY ELECTRICAL CONNECTOR

RELATED APPLICATION

This application claims the benefit of U.S. Provisional Application No. 60/227,855 filed Aug. 23, 2000, the disclosure of which is hereby incorporated by reference.

BACKGROUND OF THE INVENTION

1. Field of the Invention

This invention relates to the field of electrical connectors and, in particular to a mechanism for aligning an electrical connector such as a coupling for a printed circuit board (PCB) and another electronic component. Specifically, this invention is an alignment mechanism having a sensing device and alignment mechanism which automatically position the electrical connector.

2. Description of the Related Art

In the design of many electronic circuits and components, factors such as space savings and connection integrity are pivotally important. High-density electrical connectors are typically used in a number of electronic applications to conductively join components which contain numerous discrete paths of conductivity to be precisely aligned and joined while maintaining a small connector size. High-density electrical connectors are typically used in the interconnection between packaged integrated circuits (PIC) and printed circuit boards (PCB). In these devices, permanent attachment of one component to another by methods such as soldering may not be desirable due to the inflexibility of the solder connections which are prone to breakage under stress. Furthermore, permanent attachment precludes the desirable ability to disconnect the two components as needed.

Still other applications of high-density electrical connectors can be found in wiring applications where cable, ribbon, or wire bundle arrangements are used to interconnect components within electronic devices which may not be suitable for direct attachment to each other. These wiring arrangements and connectors are likewise configured to be removably attached to one or more of the components which they interconnect. In both of the abovementioned applications, the high-density electrical connector possesses a large number of discrete conductors which must be properly oriented and securely positioned so as to insure connection integrity between the components to be joined.

Conventional pin/socket or plug/receptacle arrangements which are manually positioned, oriented, and joined to provide connectivity between electronic components are inadequate for use in many high-density conductor applications. These connectors are cumbersome to work with and are prone to interconnect failure, breakage, and short-circuiting because of the close proximity of the contacts and fine control over positioning required to achieve sufficient conductivity along all contact points. Furthermore, such connectors are often not suitable for use in applications requiring repeated coupling/uncoupling of the connector and may rapidly become worn resulting in reduced connection efficacy.

In an effort to improve reliability in high-density connection arrangements, various types of connectors have been developed to use thermally responsive electrical elements which employ shape metal alloys (SMA) to secure or release the connector. Using the SMA property of heat induced phase transformation, these connectors typically operate by securing or releasing the connector based on electrical current flow through the alloy. SMA actuated clamps and fasteners for electronic devices have been described for high-density electrical applications and may provide a reversible locking mechanism. Such devices, however, are still subject to the inherent problems of component movement and connection failure should the connection interface be improperly oriented or misaligned. Furthermore, SMA connectors described in the prior art do not provide precise control over the positioning and orientation of the connector interface and suffer from alignment problems associated with manual positioning and attachment. Thus, it is difficult to achieve satisfactory connectivity in high-density connector applications using existing SMA connectors. Additionally, these devices lack a suitable method for detecting the position of the connector which, if known, can be helpful in determining what corrections should be made to the connector position to achieve proper connectivity. These problems are exacerbated in high-density electrical connection applications due to the relatively small size of the connector and the number of contacts which must be made.

From the foregoing, it can be appreciated that there is an ongoing need for a device and method for providing connectivity between electronic components using high-density connection arrangements. Accordingly, there is a need for a device capable of detecting the orientation of a component with a high-density pattern of contacts and making fine adjustments as needed to achieve connection integrity.

SUMMARY OF THE INVENTION

The aforementioned needs are satisfied by the present invention, which in one aspect comprises a high-density electrical connector. The connector comprises a first connector member with a first and second side with a plurality of electrical conductors connected to the first side. A first contact pattern comprising a first plurality of electrical contacts is further defined on the second side of the connector with the electrical contacts connected to the corresponding electrical conductors. The connector allows many electrical conductors to be oriented and positioned in a simultaneous manner using a simplified connector interface. A benefit derived from use of the connector resides in the reduced difficulty in deciphering proper wiring arrangements and conductor orientations. A further benefit of the connector stems from the ability to fashion the connector to occupy a reduced amount of space compared to the amount of space used by traditional electrical connectors.

In the illustrated embodiments, the conductors may comprise wires, cables, or extend from a packaged integrated circuit assembly to be desirably conductively joined to a mounting location or receptacle. The mounting location is further formed on a second connector member having a first surface with a corresponding second contact pattern comprising a second plurality of electrical contacts.

An alignment mechanism engages with the first connector member and the second connector member to precisely align the contact patterns using a sensor assembly and a positioning assembly. The alignment mechanism detects the state of alignment of the connector members through the use of the sensor assembly and further re-positions the connector to insure that the contact patterns of the connector members are desirably conductively joined. In one aspect, the alignment mechanism comprises electronically-actuated pushrod assemblies which generate a bias against the connector sides to align the connector.

Signals generated by the sensor assemblies can be efficiently received and interpreted by a control unit which decodes the current state of alignment of the connector and directs electrical current, corresponding to positioning responses, to the alignment mechanism. The electrical current, received by the alignment mechanism, activates the positioning assembly and alters the bias generated by the pushrod assemblies to result in the lateral and rotational movements of the connector member required to conductively align the contact patterns.

The connector is beneficially used to align high-density contact patterns in an automated manner with an increased degree of precision. The method for precisely aligning the contacts of the contact patterns is initiated by first grossly aligning the contact patterns by positioning the first connector member in proximity to the second connector member. The connector then electrically senses whether the first and second connector members are precisely aligned and electrically induces movement between the connector members in response to the electrical sensing of whether the connector members are aligned.

These and other advantages and features of the present invention will become more fully apparent from the following description and appended claims taken in conjunction with the accompanying drawings.

DETAILED DESCRIPTION OF THE PREFERRED EMBODIMENT

Figure 1A:
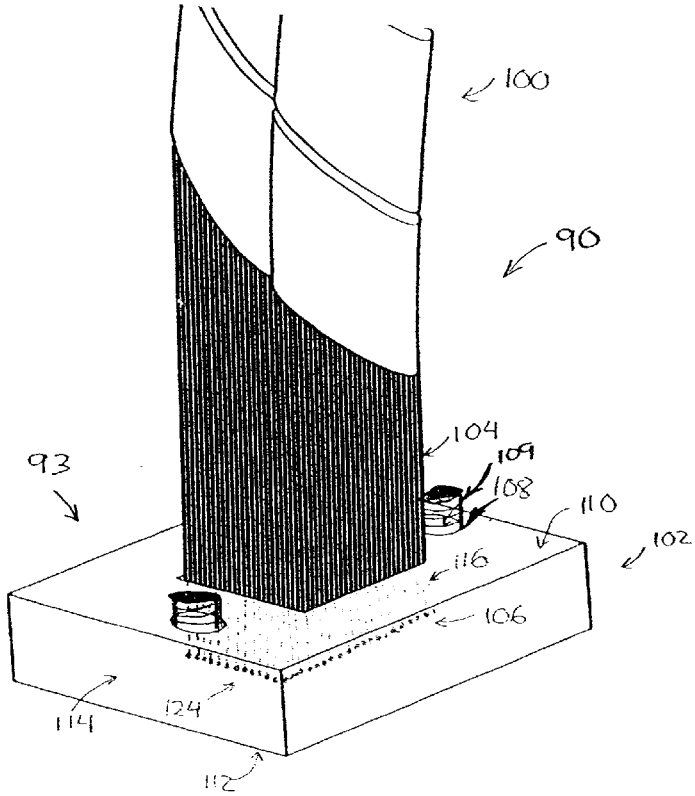
FIG. 1A is a perspective view of a high-density cable and position adapter according to the invention.

Reference will now be made to the drawings wherein like numerals refer to like parts throughout. FIG. 1A illustrates a perspective view of a high-density electrical connector 90, comprising a wiring array or conductor cable 100, attached to a first connector member 93. In the illustrated embodiment, the first connector member 93 comprises a pattern adapter 102 which secures a plurality of wires 104 (comprising the high-density wiring array or cable 100) wherein all of the wires 104 are aligned in a simultaneous manner by movement of the pattern adapter 102 through various spatial positions and orientations. The wires 104 of the conductor cable 100 may further comprise multiple types and sizes (gauges) of wire which, by way of example, may include; coaxial wire, shielded wire, unshielded wire, solid wire, stranded wire, insulated wire, uninsulated wire, and optical fiber. In one aspect, the wire ends 106 are affixed to the pattern adapter 102 in a conductively isolated manner so as to allow discrete signals or currents to be conducted through the wires 104 and pattern adapter 102.

In one aspect, the pattern adapter 102 further comprises a substantially rectangular structure having a first 110 and second 112 surface and side surfaces 114. Additionally, in the illustrated embodiment, the pattern adapter 102 contains a plurality of centrally disposed embedded channels 116 permitting the passage of the wires 104 through the pattern adapter 102. Each channel 116 extends from the first surface 110 in a throughgoing path to the second surface 112 of the pattern adapter 102. The material from which the pattern adapter 102 is constructed allows closely arranged channels 116 to be formed to accommodate the tightly packed arrangement of wires 104 of the conductor cable 100. A number of materials are suitable for construction of the pattern adapter 102 and may include, for example: plastic, nylon, epoxy, and metal, among other materials. In one aspect, the pattern adapter surfaces 110, 112 are further dimensioned to contain an area approximately equivalent to the cross sectional area of wire array or conductor cable 100 to which the pattern adapter 102 is attached. Additionally, the pattern adapter 102 desirably accommodates the conductive joining of a wire or cable density between approximately 100 wires or cables per $cm^2$ and 1600 wires or cables per $cm^2$.

In one aspect, the channels 116 of the pattern adapter 102 comprise openings through which individual wires 104 may pass. When passed through the channel 116, each wire 104 may be further secured in position by adhesive bonding, solder or welding forming a first plurality of electrical contacts 118 (FIG. 2A) present on the second surface 112 of the pattern adapter 102. In another aspect, the channels 116 of the pattern adapter 102 may comprise conductive regions joining the first surface 110 and second surface 112 and wherein the first plurality of contacts 118 are formed along the second surface 112 of the pattern adapter 102 and further conductively joined to the first surface 110 through the channels 116. In this embodiment, each wire 104 is preferably secured to the first surface 110 of the pattern adapter 102 and further secured to the conductive regions comprising channels 116 by suitable means such as adhesive bonding, solder or welding contacts. Thus, a path of conductivity is made to extend from the wire end 106 secured to the conductive channel 116 on the first surface 110 of the pattern adapter 102 , through the conductive channel 116 of the pattern adapter 102, to a point where the conductive channel 116 is joined with the electrical contacts 118 which form a first contact pattern 124 present on the second surface 112 of the pattern adapter 102.

The pattern adapter 102 may further comprise mechanisms for fixedly attaching the pattern adapter 102 on a receiving surface which desirably possesses a second pattern of receiving contacts corresponding to those present on the second surface 112 of the pattern adapter 102. When the pattern adapter 102 is properly aligned, the mounting mechanisms are secured so as to retain the pattern adapter 102, and the first contact pattern 124 therein, in a desirable orientation, conductively joining the wires 104 of the high-density electrical connector 100 to a second pattern of contacts of the receiving surface as will be shown in subsequent illustrations. The mounting mechanism for securing the pattern adapter 102 may further include openings or recesses 108 that, for example, may receive attachment devices 109 comprising screws, rods, tabs, latches, epoxy structures or other mounting structures designed to secure the pattern adapter 102 to the mounting location. In another aspect, the pattern adapter 102 may desirably remain unsecured so as to allow the pattern adapter to be continuously aligned, providing a "live" and active positioning method.

In the illustrated embodiment, a rectangularly shaped pattern adapter 102 is shown, however, the pattern adapter 102 can be readily adapted to other shapes and sizes to accommodate additional wiring/cable arrangements and attachment mechanisms which therefore represent additional embodiments and applications as should be appreciated by those of skill in the art.

Figure 1B:
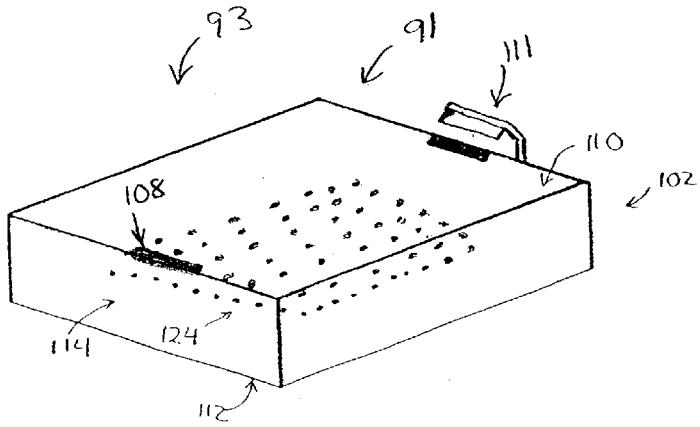
FIG. 1B is a perspective view of a packaged integrated circuit adapter according to the invention.

An additional embodiment of the first connector member 93 is shown in FIG. 1B. The first connector member 93 forms a pattern adapter 102 from a packaged integrated circuit (PIC) housing, microchip, or other self-contained electronic device. The packaged integrated circuit adapter 91, comprises similar structural features as the high-density electrical connector 90 (FIG. 1A). In one aspect, the pattern adapter 102 shown in FIG. 1B has a first surface 110 and second surface 112 with side surfaces 114. Additionally, a first contact pattern 124 is formed along the second surface 112 to allow the electronic components of the PIC to be conductively joined to other components in a manner that will be described in greater detail hereinbelow. As shown in the illustrated embodiment, recesses or openings 108 may be present along the adapter sides 114 and are used to secure the adapter 102 following alignment using a suitable mounting method 111 such as, for example, latches, screws, pins, or epoxy structures.

Figure 2A:
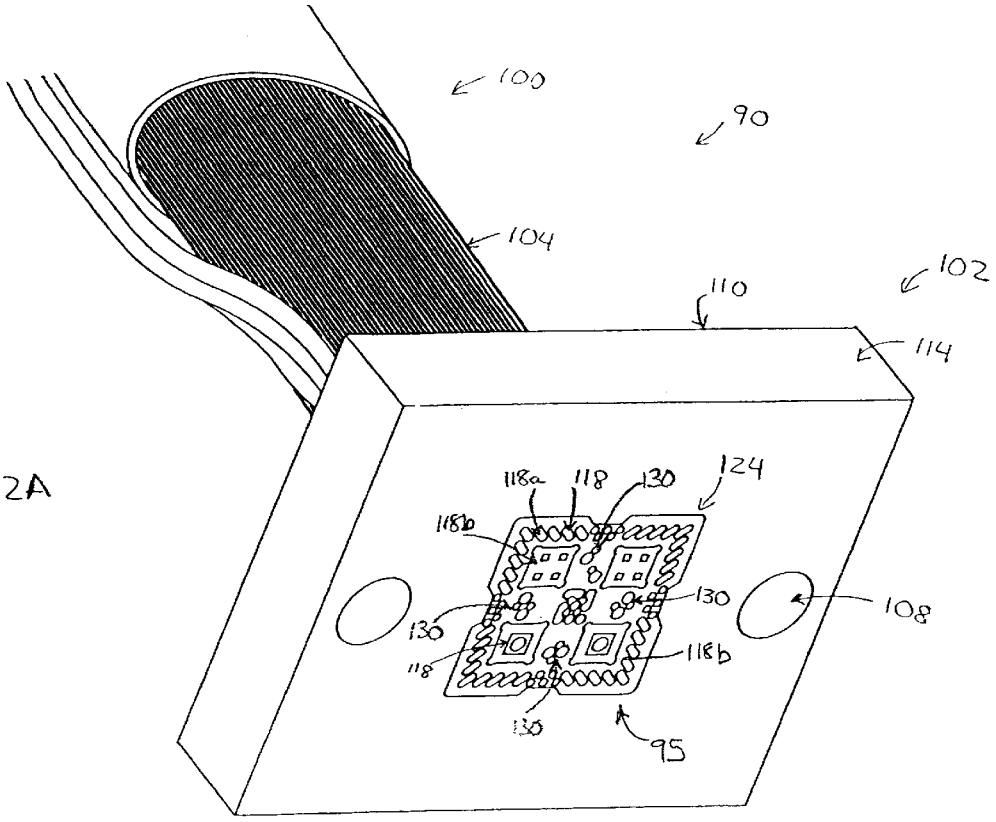
FIG. 2A is a perspective view of the high-density cable and pattern adapter illustrating the second surface and a first contact pattern of the pattern adapter.

A perspective view of the pattern adapter 102 further detailing the second surface 112 is illustrated in FIGS. 2A. A centrally disposed first contact pattern 124 is formed from numerous/discrete connections to individual wires 104 as previously illustrated. The first contact pattern 124 comprises a plurality of conductive surfaces or contacts 118, which in one embodiment comprise solder platin or welding points, that are received by a plurality of corresponding receiving contacts as will be shown in detail in later Figures. The illustrated first contact pattern 124 may further comprise large and small contacts 118*a*, 118*b* corresponding to the different sizes and types of wiring 104. It should be appreciated by those of skill in the art that the illustrated first contact pattern 124 is but one of many possible embodiments and, as such, the first contact pattern 124 can be modified to accommodate any high-density cable array arrangement or wiring scheme without detracting from the spirit of the invention. Furthermore, additional embodiments of the present invention may include other devices or components such as PIC adapters comprising a similar first pattern of contacts 124 to be desirably aligned with a second surface and corresponding contact pattern as shown in FIG. 2B.

In one aspect, the dimensions of the contact pattern and individual contacts are desirably formed in a high-density arrangement with a density of approximately 100 contacts per $cm^2$ and 1600 $cm^2$. It will be appreciated by those of skill in the art, however, that the pattern of contacts 124 can accommodate higher or lower contact densities and, as such, are considered to be additional embodiments of the present invention.

Figure 2B:
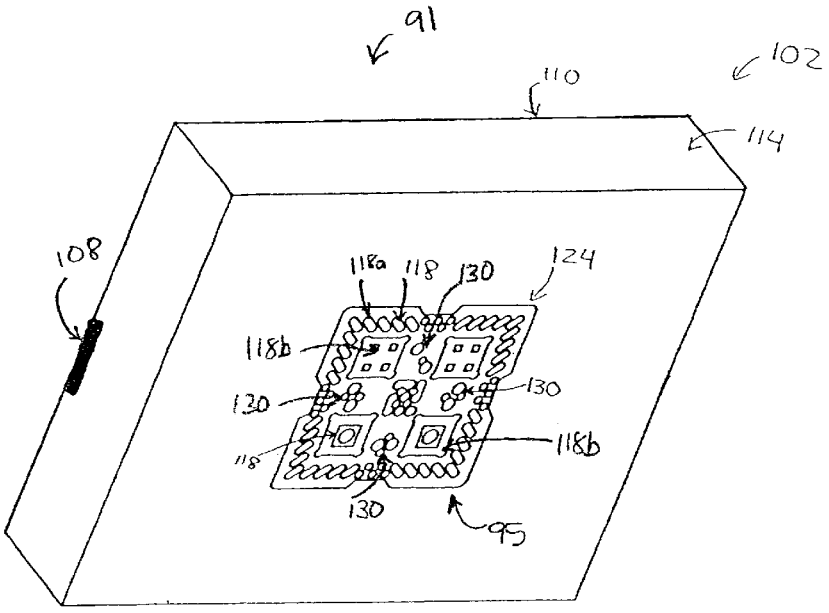
FIG. 2B is a perspective view of the packaged integrated circuit adapter illustrating the second surface and a first contact pattern of the pattern adapter.

In both of the abovementioned pattern adapter embodiments, illustrated in FIGS. 2A, 2B, a sensor assembly 95 comprising a plurality of sensing contacts 130 are further arranged about the second surface 112 of the pattern adapter 102. The sensing contacts 130 comprise conductive surfaces which are disposed within the first contact pattern 124 and are used by the sensor assembly 95 to determine the state of alignment of the pattern adapter 102 in a manner that will be described in greater detail hereinbelow. The size, number, and placement of the sensing contacts 130 on the second surface 112 of the pattern adapter 102 desirably does not occupy a large area increasing the available space for the high-density wiring contacts 118. The arrangement of sensing contacts 130 further allows for detection of the orientation and position of the pattern adapter 102 when placed in an appropriate mounting location by forming a "bridge" and closing a sensor circuit when the pattern adapter is mounted in a manner that will be described in greater detail in subsequent figures.

Figure 3A:
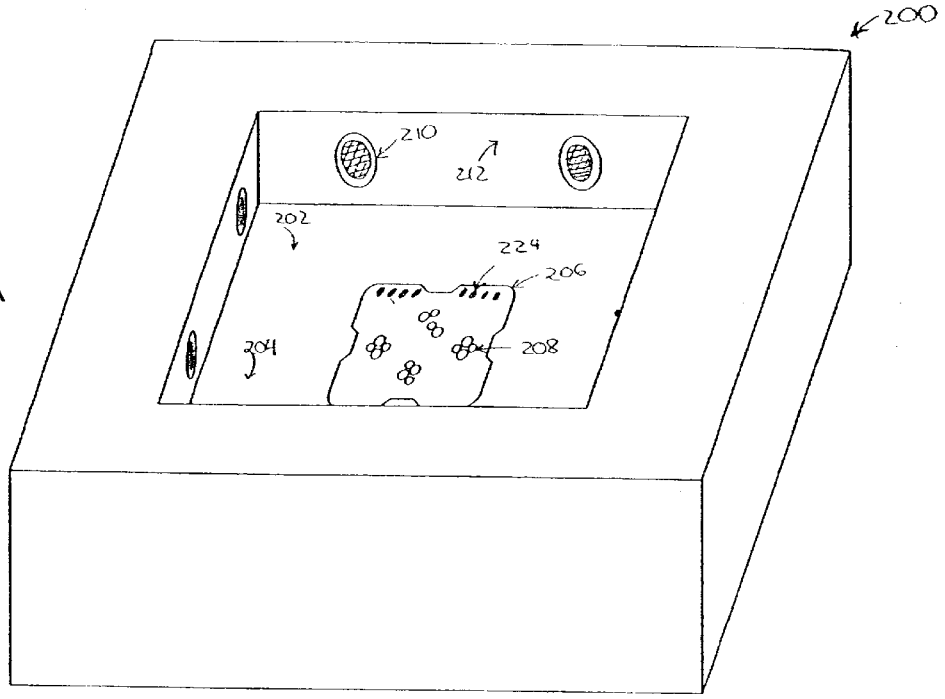
FIG. 3A is a perspective view of one embodiment of the mounting location having pushrod assemblies located along recess sidewalls.

A second connector member comprising a mounting location or receptacle 200, designed to receive and finely adjust the position of the pattern adapter 102, is illustrated in FIG. 3A. In the illustrated embodiment, the receptacle 200 comprises a solid member, substantially rectangular in shape, with a rectangular recess 202 centrally disposed within the receptacle 200. The recess 202 is configured to be sized and shaped to enclose the second surface 112 and sides 114 of the pattern adapter 102 (FIG. 2). Proper positioning of the pattern adapter 102 commences with the manual placement of the pattern adapter 102 into the recess 202 with the second surface 112 of the pattern adapter 102 resting on a first surface 204 of the receptacle 200. The area of the recess 202, defined in part by recess sidewalls 212, is further configured to have a small amount of space residing between the recess sidewalls 212 and the pattern adapter sides 114 when the pattern adapter 102 is positioned on the receptacle 200. Furthermore, it will be appreciated by those of skill in the art that the aforementioned recess 202 which houses the pattern adapter 102 may be fashioned using a shallow recess or indentation on the receptacle 200 to partially enclose the second surface 112 and adapter sides 114.

The space residing between the recess sidewalls 212 and the pattern adapter sides 114 is the result of manufacturing tolerances and permits the pattern adaptor 102 to be positioned within the receptacle 200 in a non-friction manner. Positioning the pattern adaptor 102 within the recess 200 results in the contacts 118 on the adaptor 102 being grossly aligned with a corresponding second plurality of contacts 224 on the first surface 204 of the receptacle 200. However, as the density of the contacts on the adaptor 102 and on the first surface 204 of the receptacle 200 increase, the spacing between the side walls 114 of the adaptor 102 and the side walls 212 of the receptacle 200 can result in misalignment of the contacts 118, 224 even though the adaptor 102 is correctly positioned within the receptacle 200. The alignment mechanism of the illustrated embodiment is, however, specifically adapted to achieve proper alignment of the contacts 118, 224 following positioning of the adaptor 102 in the receptacle 200 in the manner that will be described in greater detail hereinbelow.

The receptacle 200 additionally contains a plurality of pushrod assemblies 210 positioned about the recess sidewalls 212 and provides a method to moveably position the pattern adapter 102 within the recess 202. In the illustrated embodiment, the pushrod assemblies 210 are centrally disposed within the recess sidewalls 212 with two pushrod assemblies 210 present on each sidewall.

The first surface 204 of the receptacle 200, upon which the pattern adapter 102 rests, additionally forms a second contact pattern 206 comprising a second plurality of electrical contacts 224. The second contact pattern 206 and second electrical contacts 224 are formed to have substantially the same shape and number of contacts as the first contact pattern 124 present on the second surface 112 of pattern adapter 102. The pattern adapter 102 is properly aligned within the recess 202 of receptacle 200 when the first contact pattern 124 and second contact pattern 206 are in direct and continuous contact and wherein each contact of both the pattern adapter 102 and receptacle 200 are aligned with the corresponding contact of the opposing surface. In one aspect, proper alignment in the aforementioned manner desirably creates discrete paths of conductivity which can be used to join the individual wires 104 of the high-density cable 90 with other electrical components or devices connected to the receptacle 200.

The second contact pattern 206 additionally comprises a plurality of alignment sensors or probes 208 used to detect the position and orientation of the pattern adapter 102 when inserted into the receptacle 200. In the illustrated embodiment, alignment sensors 208 are embedded within the second contact pattern 206 in areas unoccupied by the second plurality of electrical contacts 224. The alignment sensors 208 provide signals to direct the activity of the pushrod assemblies 210 to reposition the pattern adapter 102, as needed, and align the first contact pattern 124 and the second contact pattern 206 in a manner that will be discussed in subsequent illustrations.

Figure 3B:
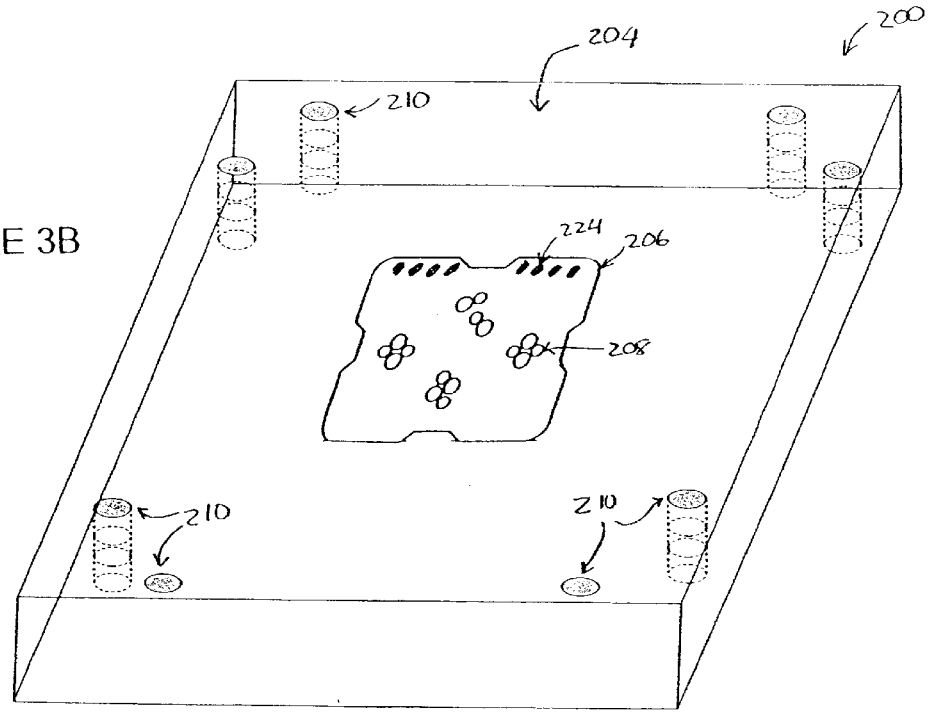
FIG. 3B is a perspective view of another embodiment of the mounting location having pushrod assemblies co-planarly located with a second contact pattern.

Another embodiment of the second connector member comprising a mounting location or receptacle 200 is shown in FIG. 3B. In this embodiment, the receptacle 200 comprises a structure wherein the second contact pattern 206 and pushrod assemblies 210 are co-located along a substantially planar surface comprising the first surface 204 of the receptacle 200. The pattern adapter 102 (FIG. 2) is further positioned with its second surface 112 resting on the first surface 204 of the receptacle 200. As with the previously illustrated receptacle 200 (FIG. 3A), a recessed area may optionally be present in the receptacle 200, into which the pattern adapter 102 is placed.

In both of the above-illustrated embodiments shown in FIGS. 3A, 3B the pushrod assemblies 210 located within the mounting location or receptacle 200 moveably position the pattern adapter 102 to desirably achieve an aligned state where the first contact pattern 124 of the pattern adapter 102 is conductively joined and aligned with the second contact pattern 206 of the receptacle in a manner that will be described in greater detail in subsequent Figures and discussion.

Figure 4A:
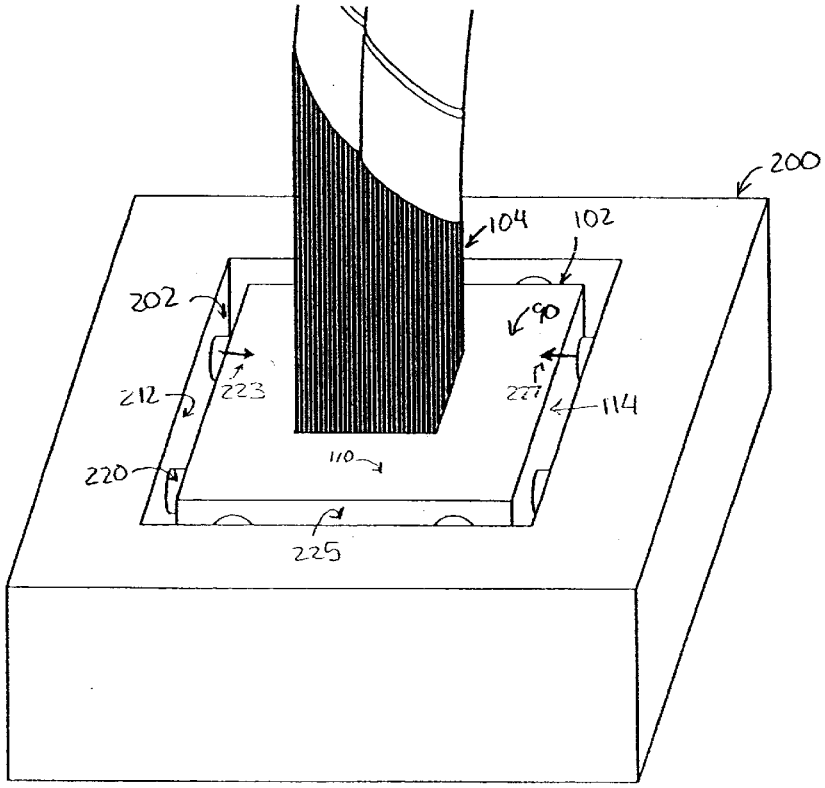
FIG. 4A is a perspective view of the high-density cable and pattern adapter showing the operation of the pushrod assemblies.
Figure 4B:
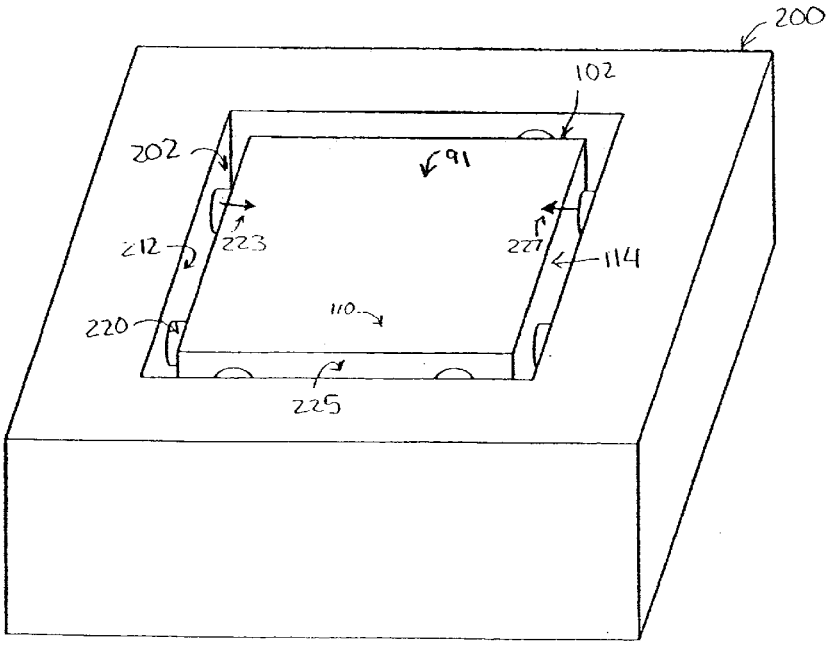
FIG. 4B is a perspective view of the packaged integrated circuit adapter showing the operation of the pushrod assemblies.

FIG. 4A, 4B illustrate the placement of the high-density electrical connector 90 and packaged integrated circuit adapter 91 respectively within the receptacle 200. The following discussion is directed towards both FIG. 4A and FIG. 4B wherein like numerals refer to like parts throughout.

As previously described, the pattern adapter 102 (corresponding to either the pattern adapter 102 of the high-density electrical connector 90 or the packaged integrated circuit connector 91) is desirably placed within the recess 202 with an open area 225 surrounding the adapter 102 to allow for adjustments in its position and orientation. When inserted into the receptacle 200, the pattern adapter 102 is engaged by each pushrod 220 which exert a bias on the adapter 102. When the adapter 102 is in a resting position, the bias 223 exerted by each pushrod 220 against the adapter sides 114 is in a state of equilibrium.

In one aspect, during positioning and alignment of the adapter 102, pushrods 220 are selectively retracted into or extended from the recess sidewalls 212. Using selectively controlled pushrod movements, the bias on the adapter sides 114 is altered to reposition the adapter 102 within the receptacle 200 using lateral and rotational movements. In the illustrated embodiment, each pushrod 220 is independently controllable and extends to engage the adapter sides 114, positioning the adapter 102 so as to insure the first contact pattern 124 of the adapter 102 remains properly aligned with the second contact pattern 206 of the receptacle 200.

Figure 5:
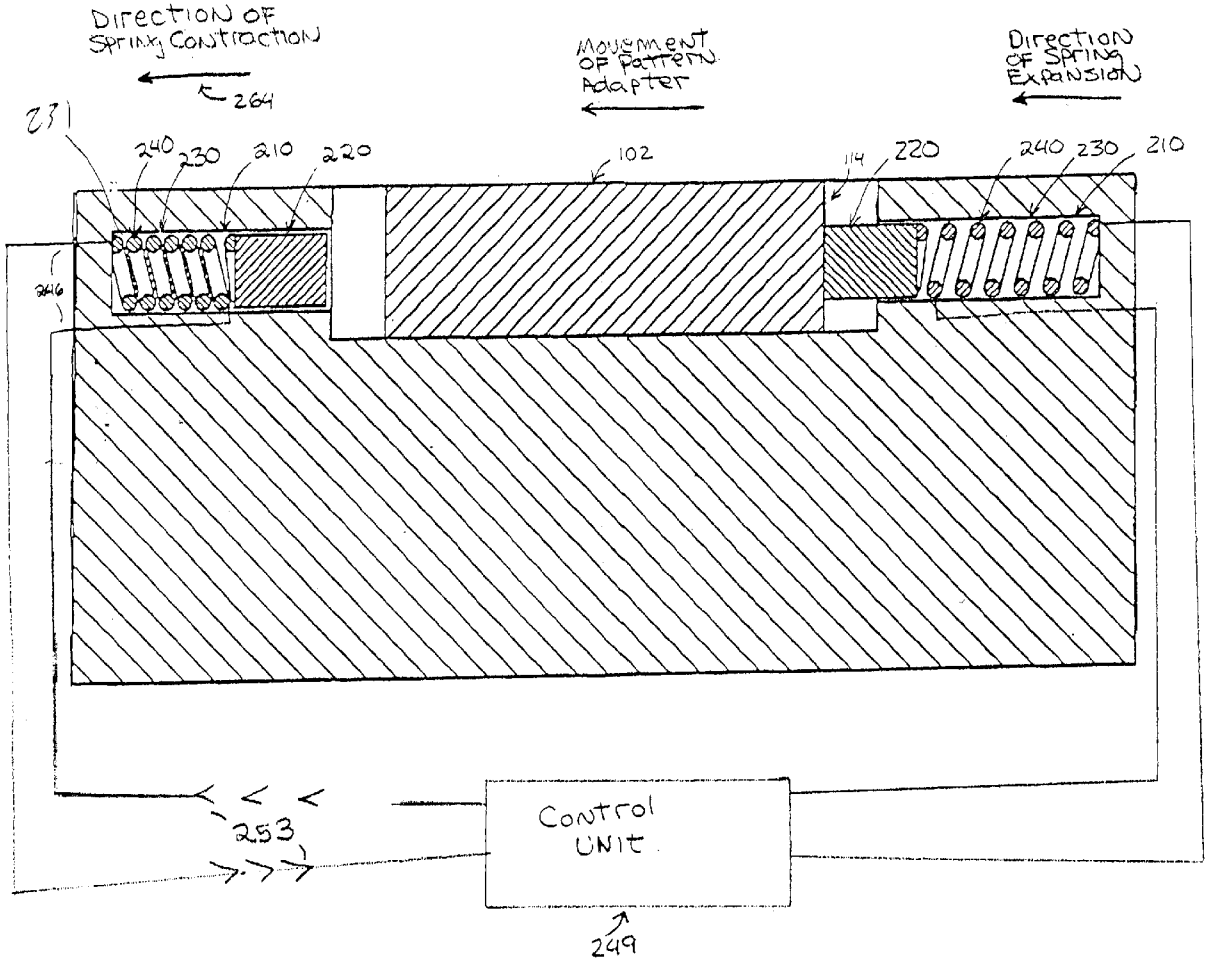
FIG. 5 is a cutaway view of the high-density cable and pattern adapter showing the operation of the pushrod assemblies.

FIG. 5 further illustrates a cross-sectional view of the mechanism for aligning the pattern adapter 102 (corresponding to either the pattern adapter 102 of the high-density electrical connector 90 or the packaged integrated circuit connector 91) using pushrod assemblies 210. Each pushrod assembly 210 comprises a pushrod housing 230 that defines a cavity 231 which contains the pushrod 220 and further contains a shaped metal alloy (SMA) spring 240. In the illustrated embodiment, the pushrod 220 is substantially cylindrical in shape and is desirably formed from a durable material such as plastic, metal, ceramic, or carbon fiber which is resistant to deformation. The spring 240 is desirably positioned behind the pushrod 220 and wholly contained within the pushrod housing 210. In one aspect, the spring 240 comprises a shaped metal alloy (SMA) coiled wire spring designed to exert an electrically controllable bias on the rear portion of the pushrod 220 as will be discussed in greater detail hereinbelow.

In one aspect, spring leads 246, comprising wires or conductive traces, are attached to the spring 240 and extend through the receptacle 200 where they are further connected to a control unit 249. The shape metal alloy forming the spring 240 is responsive to current passed through the spring 240. In one aspect, the control unit 249 selectively directs the flow of current 253 through the spring leads 246 to the spring 240 altering its physical state. When sufficient electrical current 253 is passed through the spring 240, the internal resistance of the shaped metal alloy results in the heating of the spring 240. The spring 240 is desirably heated in this manner to produce a controllable contraction 264 of the spring 240 as the alloy composition changes crystalline state from a low temperature martensite form to a high temperature austenite form as is known in the art of thermally responsive metal composition and manufacture. The temperature-dependent change in crystalline state of the spring 240 results in contraction of the spring 240 and reduces the bias exerted by the spring 240 along the bottom of the pushrod 220. The reduced spring bias further reduces the bias 223 (FIGS. 4A, 4B) exerted by the pushrod 220 on the adapter side 114 and results in a shift in position of the pattern adapter 102 as the bias of other pushrods 220 against other adapter sides 114 exceeds the bias of the contracted spring 240 and pushrod 220. Thus, with each pushrod contraction, a new state of equilibrium between the pushrods 220 and the adapter sides 114 is attained and results in the controllable positioning of the pattern adapter 102 within the receptacle 200.

In one aspect, the pattern adapter 102 is dimensioned to have sides of approximately 1 cm to 10 cm in length. Additionally the magnitude of the force or bias generated by the springs 240 which is exerted and the pushrod 220 and further exerted on the adapter side 114 is in the range of 10 Newtons and 140 Newtons.

Figure 6A:
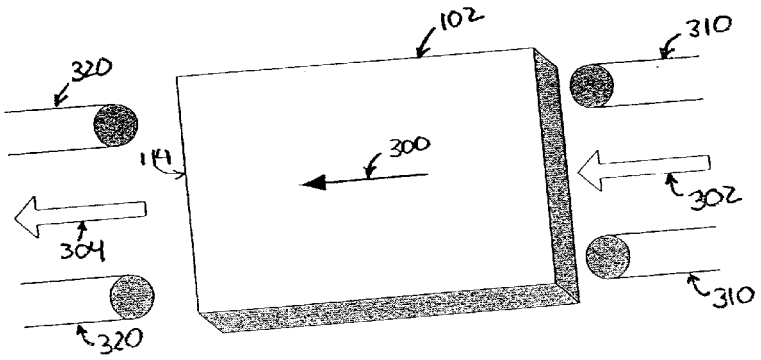
FIGS. 6A and 6B are illustrate of the moveable positioning of the pattern adapter in lateral and rotational directions by the pushrod assemblies.

In one aspect, coordination of the forces exerted by various pushrod combinations desirably directs the movement and orientation of the pattern adapter 102 with a fine level of precision. FIGS. 6A, B illustrate exemplary pushrod engagement combinations which result in different repositionings of the pattern adapter 102. As shown in FIG. 6A, lateral movement 300 is achieved by directing current through springs 240 of two pushrod assemblies 210 present along one side 114 of the adapter 102. The resulting retraction 304 of the pushrods 320 reduces the bias on the adapter side 114 and is accompanied by a concomitant repositioning of the adapter 102 resulting from the bias directed by pushrods 310 present along the opposing side of the adapter 102, which extend 302 and reposition the adapter 102 in the lateral direction 300 as shown.

Figure 6B:
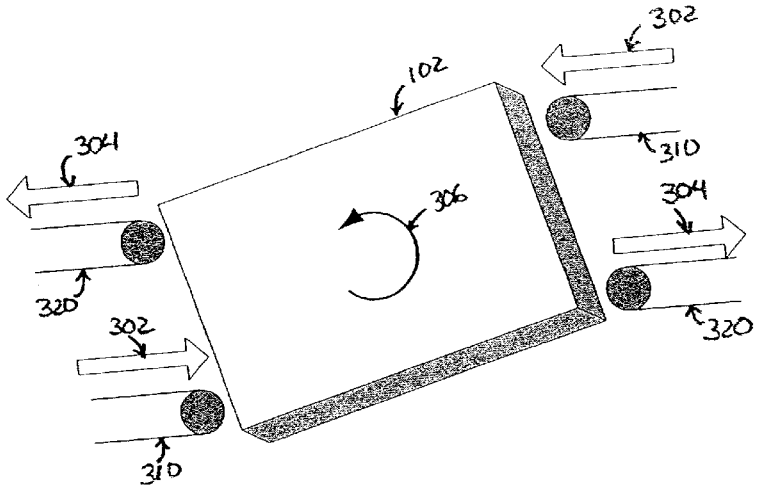

Rotational movements of the pattern adapter 102 are likewise achieved by engaging other pushrod 220 combinations. As shown in FIG. 6B, retraction 304 of pushrods 320 positioned along opposite sides 114 of the adapter 102 results in a counterclockwise repositioning of the adapter 102. The rotational movement is achieved through the coordinated bias exerted by extension 302 of the selected pushrods 310 following the retraction 304 of other selected pushrods 320.

While the previous examples demonstrate two possible methods by which the adapter position is altered, it will be appreciated by those of skill in the art that through the use of selective pushrod engagement, other positional variations can be achieved using other combinations of pushrod motion to achieve desirable results in moving the pattern adapter 102 along other vectors. In one aspect, the electrically directed retraction of selected pushrods may be replaced with an electrically directed extension of selected pushrods. In this embodiment, the spring material is selected to expand following current passage through the spring and may be alternatively used to exert controllable bias against the adapter sides to result in the repositioning of the adapter 102 as needed.

Using the aforementioned methods of electrically induced spring contraction/expansion, the plurality of pushrods 220 present along the adapter sides 114 are directed to exert positioning bias on the high-density electrical connector 90 which may be repositioned within the recess 202 of the receptacle 200 as necessary. Thus, proper contact between the second surface of the adapter 112 and the first surface 204 of the receptacle 200 is maintained in a finely controlled manner with superior precision over existing methods of alignment.

Figure 7A:
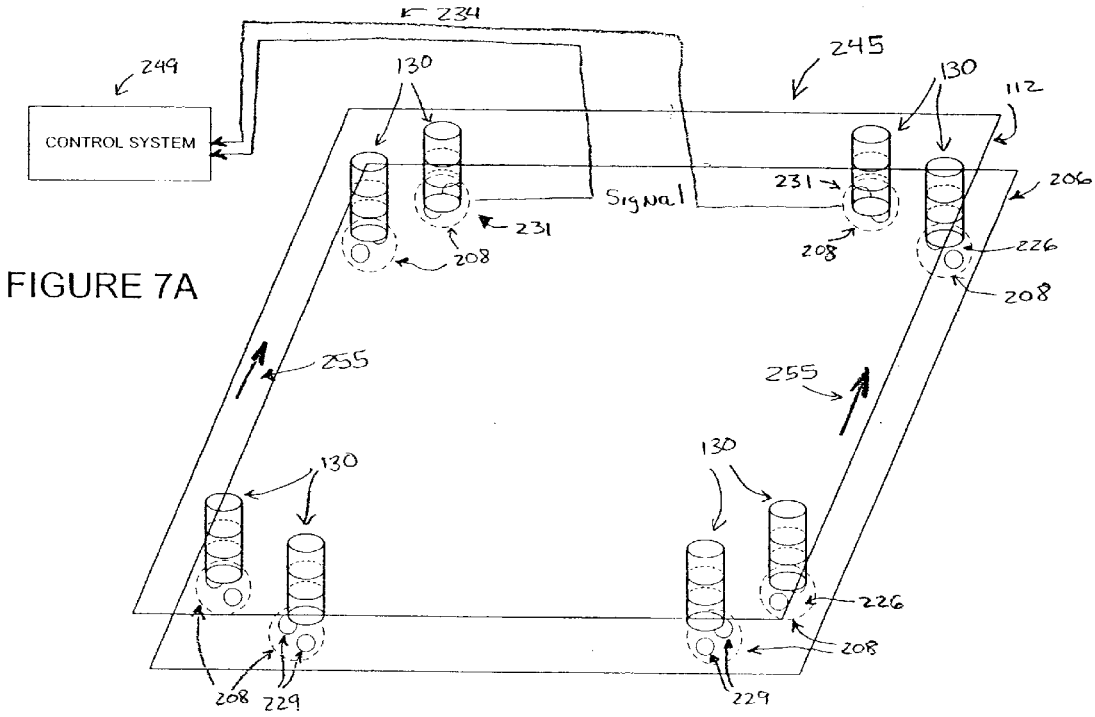
FIG. 7A illustrates one embodiment of the present invention for correcting a misaligned contact pattern and sensors.

FIGS. 7A, B further illustrate the method by which the pattern adapter 102 position is detected and altered to align the first contact pattern 124 of the pattern adapter 102 with the second contact pattern 206 of the receptacle 200. In the illustrated embodiment, the second contact pattern 206 is shown with a plurality of alignment sensors or probes 208 located substantially adjacent to each corner of the second contact pattern 206. Each sensor 208 comprises a region 226 wherein a conductively isolated lead pair 229 is positioned. In one aspect, the lead pair 229 is connected to the control unit 249 which further detects current flow through the lead pair 229 when conductively joined. The exposed portion of each lead pair 229 comprises an electrically-conductive material which is present on the surface of the second contact pattern 206.

The sensing contacts 130 on the second surface 112 of the pattern adapter 102 comprise conductive surfaces formed to be of substantially the same size as the alignment sensors 208. The sensing contacts 130 are further positioned about the alignment sensors 208 so as to conductively join the lead pair 229 of the alignment sensors 208 when the pattern adapter 102 is misaligned. In one aspect, conductive joining of the lead pair 229 issues a signal to the control unit 249 in a manner that will be discussed in greater detail in subsequent Figures and discussion.

As shown in FIG. 7A, an exemplary misaligned pattern adapter 245 is positioned over the second contact pattern 206 of the receptacle 200. In the illustrated embodiment, the misaligned pattern adapter 245 results in the positioning of sensing contacts 130 over the region of the alignment sensor 208 and further conductively joins the lead pair 229 of two alignment sensors 231. While in this position, a signal 234 is issued to the control unit 249 corresponding to each alignment sensor 208 which is triggered by conductive joining of the lead pair 229 by the sensing contact 130. In one aspect, the control unit 249 responds to the triggering of an alignment sensor 208 by engaging selective pushrods 220 (FIG. 5) to reposition the adapter 102 in the alignment direction 255 indicated until the signal 234 received from the alignment sensor 208 has ceased.

Figure 7B:
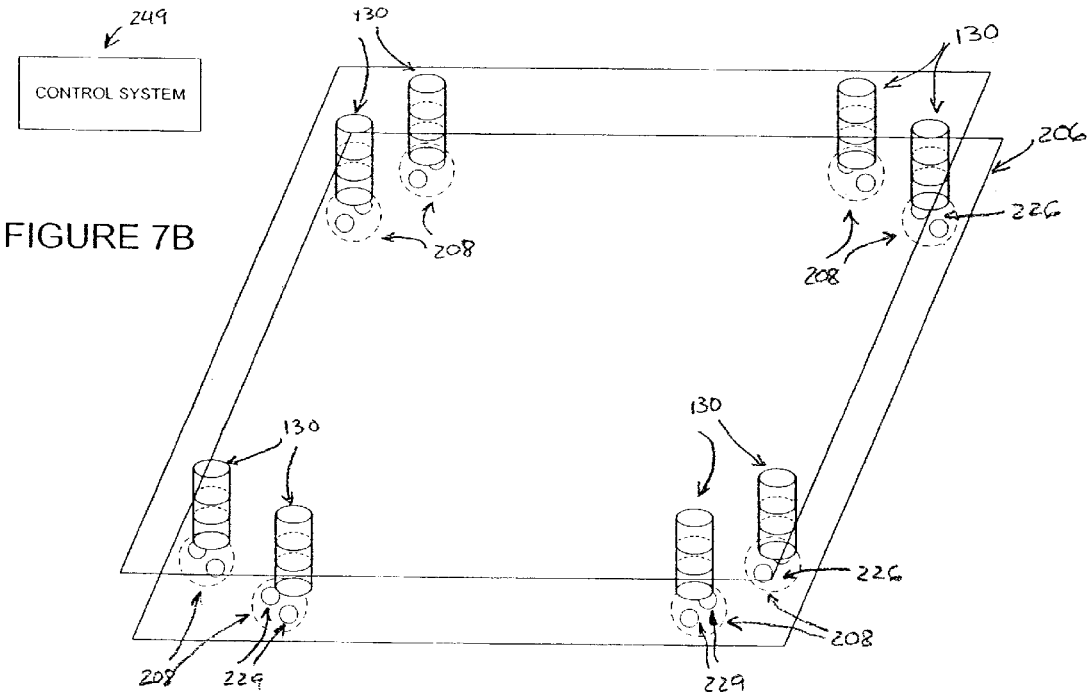
FIG. 7B illustrates one embodiment of the present invention showing the properly aligned contact pattern and sensors.

FIG. 7B illustrates a properly aligned first contact pattern 124 and second contact pattern 206. In the illustrated embodiment, selective pushrod engagement results in the repositioning of the pattern adapter 102 wherein each sensing contact 130 rests in a position where the lead pair 229 of the alignment sensor 208 is not conductively joined by the sensing contact 130. In this position, the pattern adapter 102 and its corresponding first contact pattern 124 are aligned with the second contact pattern 206 of the receptacle 200. Furthermore, in the aligned position, the alignment sensors 208 remain untriggered. Thus, the current position of the pattern adapter 102 is maintained and the pattern adapter 102 can be subsequently secured using the aforementioned methods of mounting for securing the pattern adapter 102 to the first surface.

Figures 8A, 8B, 8C:
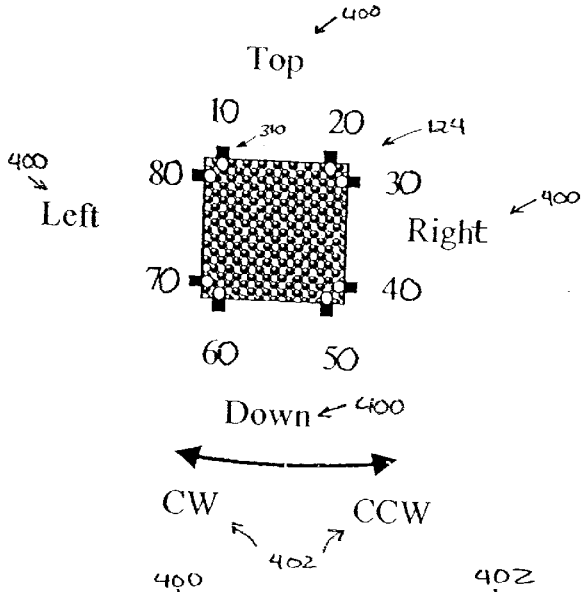
FIG. 8A illustrates one embodiment of the present invention showing a pattern of sensing contacts on the pattern adapter.
FIGS. 8B and 8C illustrate the state tables used by the control unit to decode the position of the pattern adapter and issue re-positioning commands based on the pattern shown in FIG. 8A.

FIGS. 8A, B, C illustrate one embodiment of the method by which the sensor information is processed by the control unit to position the adapter within the receptacle. As shown in FIG. 8A, the sensing contacts 130 are located in pairs substantially adjacent to each corner of the first contact pattern 124. When the adapter 102 is placed within the receptacle 200 (FIG. 3), the sensing contacts 130 of the positioning adapter 102 are positioned substantially over the regions where the alignment sensors 208 of the second contact pattern 206 are located (FIG. 3). When the adapter 102 is properly positioned within the receptacle 200 the first contact pattern 124 on the adapter 102 and the second contact pattern 206 in the receptacle 200 are aligned such that both patterns 124, 206 are joined, providing the desired connectivity and conductivity characteristics. While in this position, the sensing contacts 130 on the adapter 102 desirably do not conductively join with the alignment sensors 208 by remaining slightly offset so as to prevent current flow between the sensing contacts 130 and the alignment sensors 208.

While the adapter position 102 within the receptacle 200 has not reached a desired contact pattern aligned position, sensing contacts 130 conductively join with the alignment sensors 208 resulting in the control unit 249 issuing pushrod responses in a manner that will be described in greater detail hereinbelow. The conductive joining of the sensing contacts 130 with the alignment sensors 208 results in the issuance of electronic signals to the control unit 249 which interprets the signals to determine the corrections to the position of the adapter 102 required to achieve the desired contact pattern alignment. The control unit 249 directs the activity of the pushrod assemblies based on a series of state table information which define pushrod retraction combinations used to reposition the adapter 102.

In one aspect, the pushrod retraction combinations may result in repositioning of the adapter 102 in four lateral directions 400 (Top, Down, Right, Left) and two rotational directions 402 (Clockwise, Counterclockwise). The trigger state table 410 shown in FIG. 8B illustrates one embodiment showing the direction 400, 402 of desired adapter movement and resulting conductive triggering of alignment sensors 208 by the sensing contacts 130. In the trigger state table 410, each position 400, 402 (Top, Down, Right, Left, Clockwise, Counterclockwise) is defined by a set of eight trigger states 420 corresponding to the conductive triggering of the alignment sensors 208 necessary to achieve the desired positioning. The state of triggering of the alignment sensors 208 is designated by a "1" when the alignment sensor 208 is triggered by the sensing contact 130, or as untriggered and designated by a "0" in the state table. For example, should the sensing contacts 130 corresponding to the first surface of the adapter 102 trigger the upper alignment sensors (10, 20), the state table determines the response which will be issued by the control unit 249 to the pushrod assemblies 210. Thus, various combinations of alignment sensor triggering are designated by the trigger state table 410 and correspond to desired directional re-positionings which must be made by the control unit 249 and pushrod assemblies 210 to properly align the first contact pattern 124 of the pattern adapter 102 with that of the second contact pattern 206 of the receptacle 200.

It will be appreciated by those of skill in the art that other combinations of sensor triggering, defining additional state table entries, may be used to achieve the required re-positioning of the pattern adapter 102. Furthermore, the placement of the sensing contacts 130 and alignment sensors 208 may be changed to accommodate other contact patterns 124 and may define still other state tables used by the control unit 249 for adapter re-positioning movements. Thus, each of the aforementioned possible combinations represent additional embodiments of the present invention.

As previously described, the pushrods 220 positioned along each side of the adapter 102 generate a variable bias which result in adapter movements 400, 402 in the directions indicated (Top, Down, Right, Left, Clockwise, Counterclockwise). The position control state table 430, shown in FIG. 8C, illustrates each positional movement 400, 402 (Top, Down, Right, Left, Clockwise, Counterclockwise) and a corresponding set of eight motion states 403 which represent pushrod activations appropriate to achieve the desired positioning. Each set of motion states 403 is associated with a set of trigger states 420 corresponding to the desired movement necessary to align the first contact pattern 124 of the pattern adapter 102 and the second contact pattern 206 of the receptacle 200. The control unit 248 issues appropriate electrical current selectively directed to the pushrod assemblies 210 whose activity is desirably altered to re-position the pattern adapter 102. The activity of each pushrod 220 is shown as retracted (resulting from current flow 253 through the SMA spring 240) and designated by a "1", or as engaged (no current flow 253 through the SMA spring 240) and designated by a "0".

For example, to achieve a clockwise rotation 404, 406 of the position adapter 102, two combinations of pushrod activity may be used. A first combination for clockwise rotation 404 directs pushrod assemblies 210 corresponding to the locations at the upper left 10 (state 1) and lower right 50 (state 5) sides of the adapter 102 to be desirably retracted by electrical current flow 253 determined by the control unit 249. During this time other pushrods assemblies 210 are not altered by electrical current flow 253. The retraction of the pushrods 10, 50 along the two sides 114 results in a shifting of the adapter 102 in a clockwise direction 404 as a new state of equilibrium is reached within the receptacle 200. A second combination for clockwise rotation 406 is achievable in a similar manner using the control unit 249 which directs the selective retraction of the pushrod assemblies 210 corresponding to the locations at the upper right 30 (state 3) and lower left 70 (state 7) sides of the adapter 102. The other combinations of selective pushrod retraction operate in a like manner, wherein the control unit 249 directs the retraction of pushrods 220 as determined by the state table to achieve the desired movement of the adapter 102. It will be appreciated by those of skill in the art, that other combinations of control unit 249 directed pushrod activity exist which may perform desirable movements of the position adapter 102 and thus represent additional embodiments of the present invention. One example of another such movement comprises diagonal movement of the position adapter 102 within the receptacle 200.

Figures 9A, 9B, 9C:
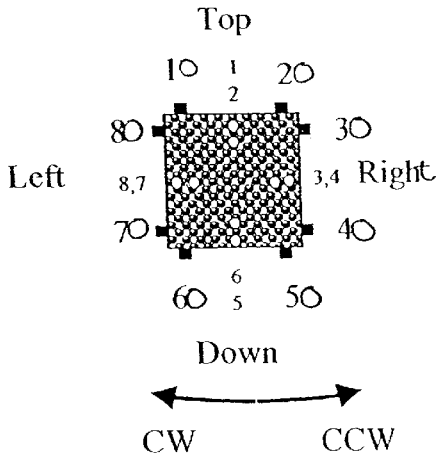
FIG. 9A illustrate another embodiment of the present invention showing a pattern of sensing contacts on the pattern adapter.
FIGS. 9B and 9C illustrate the state tables used by the control unit to decode the position of the pattern adapter and issue re-positioning commands based on the pattern shown in FIG. 9A.

Additionally, as shown in FIG. 9A, the sensing contacts 130 and corresponding alignment sensors 208 may be located in alternative positions along the adapter 102 and have a corresponding state table which defines a set of states to determine the selective retraction of the pushrods 220 by the control unit 249. In the illustrated embodiment, shown in FIG. 9A, the alignment sensors 208 are positioned in pairs substantially equidistantly from each side of the adapter 102. The resulting sensor configuration alters the trigger state table 450 (shown in FIG. 9B) for directing selective pushrod retraction as shown. In one aspect, the trigger state table 450 may include states which are designated as "don't care" states 465 (designated by an "x"), where the triggering of an alignment sensor 208 in a particular trigger state set 460 does not affect the positional decoding and resulting control unit re-positioning of the pattern adapter 102. The position control state table 470 (shown in FIG. 9C) is used by the control unit 249 to selectively retract pushrods 220 as previously described and desirably results in the repositioning of the pattern adapter 102 in lateral and rotational directions.

The high-density electrical connector assembly of the present invention thus addresses the need for an improved electrical connector and overcomes the limitations of prior art connectors in a number of ways. The pattern adapter size, shape, and construction provides a flexible method to join electrically conductive components which have a high-density of contacts and must be reliably and securely joined to other structures. The pattern adapter can additionally be scaled up or down to accommodate both large and small applications and is particularly useful in joining large collections of wire or cable which may be of different sizes. Thus, many individual contacts can be made by the use of one connector, saving time and effort compared to connecting each wire or cable individually.

Furthermore, the aforementioned high-density electrical connector assembly possesses a near zero insertion force quality when joining the contact patterns. This is important to help preserve each electrical contact's structural and conductive integrity and prevent breakage of connector during coupling and decoupling of the connector components.

In the case of high-density electrical connector applications, proper alignment and positioning of the connector can be cumbersome and difficult to achieve. The use of the shaped memory metal spring and pushrod assemblies improve the ease and precision with which the connector can be operated. Additionally, the alignment process occurs quickly and with minimal operator intervention to insure that the connector is aligned in a desired manner and continuous conductive contact is maintained.

Although the foregoing description has described the invention in context for use with an adapter present in a high density electrical connector, it will be appreciated by those of skill in the art that the other applications of the present invention exist which represent other embodiments of the present invention. In one aspect the repositioning assembly can be fashioned to be used in conjunction with, for example, an electronics module, a hybrid electronic component, an integrated circuit or other device requiring a fine level control over the positioning of the interface between adjoining surfaces.

What is claimed is:

1. A high density electrical connector assembly comprising:

a first connector member with a first and second side wherein the first connector member comprises a plurality of electrical conductors on the first side and defines a first contact pattern on the second side comprising a first plurality of electrical contacts that are connected to corresponding electrical conductors;

a second connector member that defines a first surface adapted to receive the second side of the first connector wherein the second connector member has a second contact pattern comprising a second plurality of electrical contacts formed on the first surface that correspond to the first contact pattern on the second side of the first connector member, wherein the first contact pattern is substantially aligned with the second contact pattern when the first connector member is engaged with the second connector member; and an alignment mechanism that engages with the first connector member and the second connector member wherein the alignment mechanism has a sensor assembly that determines whether the first contact pattern and the second contact pattern are precisely aligned such that there is electrical interconnection between the first and second plurality of electrical contacts and the alignment mechanism includes positioning assemblies which move the first and second connector members with respect to each other to precisely align the first and second contact patterns.

2. The assembly of claim 1, wherein the sensor assembly is formed on both the first and second connector members for sensing the alignment between the first and second contact patterns.

3. The assembly of claim 2, wherein the sensor assembly includes at least one probe formed on the second connector member and a plurality of sensing contacts formed on the first connector member wherein the probe and the plurality of sensing contacts are positioned such that the at least one probe sends signals indicative of the relative position between the first and second connector members based upon whether the at least one probe is electrically contacting one or more of the plurality of sensing contacts.

4. The assembly of claim 3, wherein the alignment mechanism further comprises an electrically activated spring that receives electrical current when the at least one probe engages with the sensing contacts in a manner that indicates that the first and second electrical connectors are not precisely aligned.

5. The assembly of claim 4, wherein the at least one alignment mechanism comprises a shaped memory metal spring that retracts when it receives an electrical current.

6. The electrical connector according to claim 5 wherein said shape-memory metal comprises a nickel-titanium alloy.

7. The assembly of claim 4, wherein the at least one probe comprises a plurality of probes that are geometrically distributed about the first surface of the second connector member and the plurality of sensing contacts are geometrically distributed about the second surface of the first connector member and the at least one alignment mechanism comprises a plurality of alignment mechanisms spaced about the second connector member so as to be able to engage a surface of the first connector member to thereby move the first connector member with respect to the second connector member in both lateral and rotational directions.

8. The assembly of claim 7, wherein the plurality of probes and the plurality of sensing contacts are geometrically distributed such that at least some of the plurality of probes engage with the plurality of contacts when the first connector member is substantially aligned with second connector member and thereby provide an electrical signal to the corresponding alignment mechanisms to thereby precisely align the first and second contact patterns.

9. The assembly of claim 8, wherein the first connector member comprises a pattern adapter having a first geometric configuration and a first and a second side and the second connector member defines a mounting location having the first geometric configuration.

10. The assembly of claim 9, wherein the mounting location further comprises a receptacle having a recess for receiving the pattern adapter.

11. The assembly of claim 9, further comprising a control unit which receives the signals sent by the at least one probe and selectively sends electrical current to the alignment mechanism and further directs the activity of the positioning assemblies.

12. The assembly of claim 11, wherein the control unit selectively engages the positioning assemblies when one or more of the plurality of probes are engaged with one or more of the plurality of sensing contacts.

13. The assembly of claim 1, further comprising a mechanism for fixedly attaching the first and second electrical connectors in a fixed relationship wherein the first and second electrical connectors are precisely aligned.

14. The assembly of claim 13, wherein the mechanism for fixedly attaching the first and second electrical connectors is selected from the group consisting of screws, bolts, rods, tabs, and latches.

15. A high-density electrical cable connector comprising:

a pattern adapter having a first side, a second side and side surfaces, the second side further comprising a first contact pattern formed from a first plurality of electrical contacts conductively joined to a plurality of wires extending from the first side, the second side further comprising a plurality of sensing contacts comprising conductive surfaces positioned about the second side;

a mounting location having a first surface wherein a second contact pattern is formed from a second plurality of electrical contacts and corresponds to the first contact pattern such that when the second side of the pattern adapter and the first surface of the mounting location are aligned and joined, the first and second contact patterns are conductively joined;

an alignment mechanism, comprising a sensor assembly which detects the alignment of the first and second contact patterns and issues signals based on the alignment, and further comprising at least one electronically actuated pushrod assembly that generates a bias against the pattern adapter to align the position of the first contact pattern with the second contact pattern;

a control unit, that receives the signals generated by the sensor assembly and induces the alignment of the first and second contact patterns by actuating the plurality of pushrods to result in lateral and rotational movements of the pattern adapter.

16. The high density electrical cable connector according to claim 15, wherein the mounting location further comprises a receptacle having a recess for receiving the pattern adapter.

17. The high-density electrical cable connector according to claim 15, wherein the plurality of pushrod assemblies further comprise a plurality of shape memory metal springs which contract when electrical current passes through the springs.

18. The high-density electrical cable connector of claim 17 wherein the shape memory metal comprises a nickel-titanium alloy.

19. The high-density electrical cable connector according to claim 18, wherein each spring exerts a bias on the pattern adapter that corresponds to signals generated by the sensor assemblies.

20. The high-density electrical cable connector according to claim 19 wherein the control unit sends electrical current through the springs causing the springs to retract thereby reducing the bias exerted by selected pushrods on the pattern adapter and furthermore resulting in re-alignment of the pattern adapter.

21. The high-density electrical cable connector of claim 15, wherein the first contact pattern comprises a geometrically distributed plurality of sensing contacts and the sensor assembly comprises a corresponding, geometrically distributed plurality of sensors.

22. The high-density electrical cable connector of claim 21, wherein the sensors generate signals based on conductive engagement with one of more of the plurality of sensing contacts.

23. The high-density electrical cable connector of claim 15, wherein the control unit further comprises a trigger state table which defines the position of the pattern adapter based on the conductive joining of the sensing contacts with the sensors.

24. The high-density electrical cable connector of claim 23, wherein the trigger state table is linked to a control state table to direct electrical current through the a least one pushrod assemblies.

25. The high-density electrical cable connector of claim 15, further comprising a mechanism for fixedly attaching the pattern adapter and mounting location in a fixed relationship wherein the first and second contact patterns are precisely aligned.

26. The assembly of claim 25, wherein the mechanism for fixedly attaching the pattern adapter and mounting location comprises is selected from the group consisting of screws, bolts, rods, tabs, and latches.

27. A device for aligning packaged integrated circuits comprising:

a packaged integrated circuit assembly having a first side, a second side and side surfaces, the second side further comprising a first contact pattern formed from a first plurality of electrical contacts conductively joined to electronic components of the packaged integrated circuit assembly, the second side further comprising a plurality of sensing contacts comprising conductive surfaces positioned about the second side;

a mounting location having a first surface wherein a second contact pattern is formed from a second plurality of electrical contacts and corresponds to the first contact pattern;

an alignment mechanism, comprising a sensor assembly which detects the alignment of the first and second contact patterns and issues signals based on the alignment, and further comprising a plurality of electronically actuated pushrod assemblies which generate a bias against the packaged integrated circuit assembly to align the packaged integrated circuit and join the contacts of the first plurality of electrical contacts with the second plurality of electrical contacts;

a control unit that receives the signals generated by the sensor assemblies and aligns the first and second contact patterns by actuating the plurality of pushrods to result in lateral and rotational movements of the packaged integrated circuit assembly.

28. The device for aligning packaged integrated circuits according to claim 27, wherein the mounting location further comprises a receptacle having a recess for receiving the a packaged integrated circuit assembly.

29. The device for aligning packaged integrated circuits according to claim 28, wherein the plurality of pushrod assemblies further comprise a plurality of shape memory metal springs that are altered by passage of electrical current through the springs to change the bias exerted by the pushrods.

30. The device for aligning packaged integrated circuits according to claim 29 wherein the shape-memory metal comprises a nickel-titanium alloy.

31. The device for aligning packaged integrated circuits according to claim 27, wherein the first contact pattern comprises a geometrically distributed plurality of sensing contacts and the sensor assembly comprises a corresponding, geometrically distributed plurality of sensors.

32. The device for aligning packaged integrated circuits according to claim 31, wherein the sensors generate signals based on conductive engagement with one of more of the plurality of sensing contacts.

33. The device for aligning packaged integrated circuits according to claim 29, wherein each spring exerts a bias on the position adapter.

34. The device for aligning packaged integrated circuits according to claim 33, wherein the control unit directs current through the plurality of springs.

35. The device for aligning packaged integrated circuits according to claim 34, wherein the control unit selectively directs the retraction of selected springs thereby reducing the bias exerted on the packaged integrated circuit assembly.

36. The device for aligning packaged integrated circuits according to claim 35, wherein the control unit further comprises a trigger state table which defines the position of the packaged integrated circuit assembly based on the conductive joining of the sensing contacts with the sensors.

37. The device for aligning packaged integrated circuits according to claim 36, wherein the trigger state table is linked to a control state table to direct electrical current through the plurality of pushrod assemblies.

38. The device for aligning packaged integrated circuits according to claim 27, further comprising a mechanism for fixedly attaching the packaged integrated circuit assembly and mounting location in a fixed relationship.

39. The device for aligning packaged integrated circuits according to claim 38, wherein the mechanism for fixedly attaching the packaged integrated circuit assembly and mounting location is selected from the group consisting of screws, bolts, rods, tabs, and latches.

40. A method of precisely aligning a first electrical connector member to a second electrical connector member such that a plurality of contacts on a first contact pattern of the first connector member is electrically connected to a corresponding plurality of contacts on a second contact pattern of the second connector member, the method comprising:

positioning the first connector member in proximity to the second connector member, such that the first and second contact patterns are grossly aligned;

electrically sensing whether the first and second connector members are precisely aligned such that first and second plurality of contacts are electrically connected to each other; and electrically inducing movement between the first and second connector members so as to precisely align the connector members in response to electrically sensing whether the first and second connector members are precisely aligned.

41. The method of claim 40, further comprising securing the first and second connector members in the precisely aligned state.

42. The method of claim 41, wherein positioning the first connector member in proximity to the second connector member comprises positioning the first connector member into a receptacle defined by the second connector member that is sized to within a manufacturing tolerance to correspond to the first connector member such that the first contact pattern and the second contact pattern are aligned to within the manufacturing tolerance of the first connector member and the receptacle.

43. The method of claim 42, wherein electrically inducing movement between the first and second connector members comprises inducing a mechanical apparatus that is engaged with the first and second connector member to move the first connector member within the receptacle such that the first connector member is precisely aligned with the second connector member.

44. The method of claim 43, wherein inducing a mechanical apparatus to move the first connector member within the receptacle comprises providing current to a shape memory alloy spring that causes a member to move thereby resulting in a bias being applied between the first and second connector members.

45. The method of claim 44, wherein electrically sensing whether the first and second connector members are precisely aligned comprises determining the relative location between at least one probe formed on the second connector member to at least one sensing contact formed on the first connector member.

46. The method of claim 45, wherein determining the relative location between the at least one probe and the at least one sensing contact comprises generating a electrical signal when the at least probe is conductively joined to the sensing contact.

47. The method of claim 46, wherein the electrical signal is further detected by a control unit.

48. The method of claim 47, wherein the control unit decodes the signal using a trigger state table to determine the first and second connector member alignment.

49. The method of claim 48, wherein the control unit induces the mechanical apparatus following decoding of the first and second connector member alignment.

50. The method of claim 49, wherein the control unit induces the mechanical apparatus by sending an electrical current to the mechanical apparatus.

51. The method of claim 50, wherein the control unit further uses a control state table to determine when to send the electric current to the mechanical apparatus.

* * * * *

UNITED STATES PATENT AND TRADEMARK OFFICE

CERTIFICATE OF CORRECTION

PATENT NO. : 6,368,146 B2
DATED : April 9, 2002
INVENTOR(S) : Russell Abbott

It is certified that error appears in the above-identified patent and that said Letters Patent is hereby corrected as shown below:

Column 1,
Line 4, please insert the following:
-- Statement Regarding Federally Sponsored Research or Development This invention was made with United States Government support under Contract F29601-00-C-0018 awarded by the United States Air Force. The United States Government has certain rights in this invention. --

Signed and Sealed this

Second Day of August, 2005

JON W. DUDAS
*Director of the United States Patent and Trademark Office*